US012024766B2

(12) United States Patent
Natrup

(10) Patent No.: US 12,024,766 B2
(45) Date of Patent: Jul. 2, 2024

(54) PROCESS FOR COATING A SURFACE OF A SUBSTRATE WITH A METAL LAYER

(71) Applicants: Sherart B.V., Helmond (NL); Frank Vitus Franz Natrup, Sprockhövel (DE)

(72) Inventor: Frank Vitus Franz Natrup, Sprockhövel (DE)

(73) Assignee: Sherart B.V., Helmond (NL)

( * ) Notice: Subject to any disclaimer, the term of this patent is extended or adjusted under 35 U.S.C. 154(b) by 0 days.

(21) Appl. No.: 17/622,012

(22) PCT Filed: Jun. 24, 2020

(86) PCT No.: PCT/NL2020/050414
§ 371 (c)(1),
(2) Date: Dec. 22, 2021

(87) PCT Pub. No.: WO2020/263089
PCT Pub. Date: Dec. 30, 2020

(65) Prior Publication Data

US 2022/0235447 A1 Jul. 28, 2022

(30) Foreign Application Priority Data

Jun. 25, 2019 (NL) ..... 2023379

(51) Int. Cl.

| | |
|---|---|
| ***C23C 10/02*** | (2006.01) |
| ***C23C 10/22*** | (2006.01) |
| ***C23C 10/24*** | (2006.01) |
| ***C23C 10/60*** | (2006.01) |

(52) U.S. Cl.
CPC ..... *C23C 10/22* (2013.01); *C23C 10/02* (2013.01); *C23C 10/24* (2013.01); *C23C 10/60* (2013.01)

(58) Field of Classification Search
CPC ..... C23C 10/22; C23C 10/02; C23C 10/24; C23C 10/60; C23C 10/20; C23C 10/18
See application file for complete search history.

(56) References Cited

U.S. PATENT DOCUMENTS

2012/0006450 A1* 1/2012 Graf ..... C23C 26/00 148/527

FOREIGN PATENT DOCUMENTS

| | | |
|---|---|---|
| DE | 750956 C | 6/1954 |
| GB | 999850 A | 7/1965 |

OTHER PUBLICATIONS

International Search Report and Written Opinion, PCT Application No. PCT/NL2020/050414, mailed Jul. 23, 2020 (8 pages).

* cited by examiner

*Primary Examiner* — Hai Y Zhang
(74) *Attorney, Agent, or Firm* — Occhiuti & Rohlicek LLP

(57) ABSTRACT

In a process for coating a surface of a substrate with a metal layer zinc is used as a coating agent. Zinc metal and said substrate are brought together at an elevated temperature in a liquid diffusion medium to allow a diffusion of zinc through said diffusion medium to said surface of said substrate. Said diffusion medium comprises a molten salt liquid, particularly molten salt bath, of at least one salt that is maintained at a bath temperature of between 200° C. and 800° C. Said substrate and zinc as a coating agent are heat treated in said bath to promote said diffusion of zinc to said surface of said substrate.

25 Claims, No Drawings

PROCESS FOR COATING A SURFACE OF A SUBSTRATE WITH A METAL LAYER

RELATED APPLICATIONS

This is the national stage of international application PCT/NL2020/050414, filed on Jun. 24, 2020, which claims the benefit of the Jun. 25, 2019 filing date of Netherlands Application No. 2023379, the contents of which are incorporated herein by reference.

The present invention relates to a process for coating a surface of a substrate with a metal layer, wherein a coating agent containing zinc and said substrate are brought together in a diffusion medium and are subjected to a heat treatment at elevated temperature to allow a diffusion of zinc through said diffusion medium to said surface of said substrate.

For a long time corrosion sensitive components, for instance made of iron or steel, are being galvanized in order to improve their corrosion resistance. On their surface, a thin layer of metal, notably of zinc, is deposited to improve the corrosion resistance of the components. Established galvanizing methods are, for example, galvanic zinc plating, zinc lamination coating, hot dip galvanizing and sherardising.

Electro-galvanizing uses electrochemical methods to deposit zinc layers or zinc alloy layers, such as Zn—Ni or Zn—Fe, on corresponding surfaces. Due to the required electric fields, the process is not very well suited for complicated substrates or cavities. A diffusion bond with the substrate does not take place. Due to the inherent properties of this process, it is not really suitable for high-strength steel parts because of a risk of hydrogen embrittlement, requiring such parts to undergo a special additional post-treatment.

Zinc lamination coatings are paint-like emulsions containing zinc and aluminum particles, which are usually applied by repeatedly dipping and drying at about 200° C. A disadvantage of this process is that the paint may remain behind in blind holes or cavities and the ultimate layers are relatively soft.

As with the aforementioned processes, also hot-dip galvanizing requires a proper pre-treatment of the components to be coated. Typical steps are de-greasing, pickling, possibly fluxing and drying. This introduces the risk of hydrogen embrittlement. Hot-dip galvanizing temperatures are usually between 440° C. to 460° C. or higher. The components are being submerged completely in liquid zinc. Depending on the process design and process time, a Zn—Fe diffusion reaction can take place between the zinc melt and the substrate surface and various Zn—Fe phases may form under a usually relatively thick zinc layer. As with zinc lamination coatings, zinc may remain behind in blind holes or cavities and screw threads often must be recut to regain precision, depending on the procedure. Due to the process temperature and other effects, such as the so-called "Sandelin effect" or the liquid metal embrittlement, not all heat treated steels and not all steel grades can be treated by this galvanizing process.

While the methods described above are most often performed in open dip baths, known sherardising techniques utilize closed rotating drums. According to this process the parts that are to be galvanized, are treated with zinc powder that is mixed with a filler, such as sand or ceramics, at a temperature between 300 and 500° C. The purpose of the filler is to ensure a uniform heating and distribution of the zinc powder. In addition, the filler reduces the risk of collision and damage of bulk components as they are being rotated and hustled in the drum.

Like hot dip galvanizing, also sherardising is a diffusion metal coating process that is applied to improve the surface properties of the substrate being treated. During sherardising, zinc diffuses through the atmosphere into the surface layer of a zinc-reactive substrate (Fe, Cu, Ni, Al, etc.) to form a conformal Zn—X layer (X=Fe, Cu, Ni, Al, etc.). The deposited diffusion layer firmly bonds to the substrate. The particular advantage of this technique is that also substrates of complicated shape can be uniformly coated. As sherardising is a dry process, also threaded ends and stud holes can be coated with zinc layers while preserving tolerances. The process is relatively robust in terms of surface pre-treatment.

A disadvantage of sherardising is that the process is being carried out in closed drums and the dry process is dusty. As a consequence it cannot be integrated easily into a pre- and/or post-treatment line of a manufacturing or assembling process. Moreover, standard sherardising cannot readily be implemented as a continuous process due to the use of closed drums in which the objects are processed under a protected atmosphere.

A published US patent application, US 2012/0006450, discloses a special form of diffusion coating process for creating a conformal zinc layer on a surface of a substrate. According to this known process a wet suspension, containing a liquid and zinc or zinc alloy, is applied onto the surface of a substrate that is to be coated. Next the suspension is dried, causing the liquid to evaporate while the dry contents, including the suspended zinc donor, remains behind on the surface as a solid layer. The assembly is then subjected to a heat treatment in a conventional furnace at between 300 and 500° C. that allows zinc to diffuse out of the dried layer. Finally the solid layer is removed by cleaning the substrate by washing, ultrasonic treatment or brushing.

Although this diffusion coating process, known from US2012/0006450, avoids the use of closed drums (retorts) that are being used in conventional sherardising, it requires a protective, oxygen-free atmosphere for the heat treatment and, moreover, a considerable number of handling and process steps.

The present invention has inter alia for its object to provide a new and innovative process for metal plating of an object that combines at least a number of the advantages of the processes that are so far known in the art, while avoiding or at least significantly counteracting the disadvantages associated with those known methods.

To that end, a process for coating a surface of a substrate with a metal layer as described in the opening paragraph, according to the present invention, is characterized in that a molten salt liquid, comprising at least one molten salt, is used as said diffusion medium, in that a metallic zinc source is added to said molten salt liquid as a source for diffusion of zinc to said surface of said substrate, and in that said heat treatment involves exposing said substrate to said molten salt liquid at elevated temperature to allow metallic zinc to diffuse to said substrate.

Particularly a molten salt bath of said at least one molten salt is thereby used as said diffusion medium, said salt bath being provided with metallic zinc as a source for diffusion of zinc to said surface of said substrate, while said substrate is entirely submerged into said molten salt bath. Particularly said elevated temperature is a temperature beyond a melting point of said at least one salt. Particularly said elevated temperature may be a temperature below a melting point of said metallic zinc source.

Like conventional sherardising, the process according to the invention is a diffusion process. The liquid salt is used as a medium that allows metallic zinc to diffuse to and into the surface of the substrate that is to be covered. The substrate may be submerged completely into the molten salt liquid. The submerged substrate will then be shielded from ambient air by the surrounding molten salt liquid. By employing a diffusion coating process, the process according to the invention enables near-contour (i.e. conformal) coating of complex geometries with high precision and process control, without filling of cavities or requiring recutting of threaded ends. Moreover, being a diffusion process, it will create diffusion bonds between the protective layer and the surface of the substrate and it will allow coating on most types of steel without a risk of hydrogen embrittlement. The process may require merely a simple pretreatment and also allows the treatment of high-strength heat-treated steels.

In the context of a specific embodiment of the present invention it has been found that by the addition of zinc to the molten salt liquid, the surface of a substrate can be readily coated with zinc if the substrate, together with zinc as a coating agent, are heat treated at a bath temperature between 200° C. and 800° C. This causes the surface of the substrate to be galvanized by producing a uniform conformal zinc coating firmly adhering to even the most intricately shaped substrates. Accordingly, a special embodiment of the process according to the invention is characterized in that said molten salt liquid is maintained at an elevated bath temperature of between 200° C. and 800° C. during said heat treatment, while said substrate is submerged in a molten salt bath of said molten salt liquid.

The maximum process temperature is basically determined by the melting point of the forming substrate phases, in order to avoid the substrate surface being melted and destroyed. If the substrate is made of aluminum, for instance, this is at about 380° C. for the associated Al—Zn eutectic phase. In view of this, a specific embodiment of the process according to the invention is characterized in that said heat treatment is carried out in a molten salt bath at a temperature below 380° C. in case of a substrate comprising aluminum.

In the case of a substrate of iron, the δ-phase (delta phase) of the Fe—Zn system has a melting point of about 620° C. The melting temperature of zinc plays a minor role, because substrate and zinc source can be spatially separated. In view of this, a specific embodiment of the process according to the invention is characterized in that said heat treatment is carried out in a molten salt bath at a temperature between 300° C. and 600° C. in case of a substrate comprising iron.

The minimum process temperature is determined mainly by economical factors. The lower the temperature, the slower the layer growth, but also the lower the energy consumption. It has been found out that in about 60 minutes at about 230° C. a 0.2 μm thick Fe—Zn layer formed on an iron substrate, while at 300° C. the layer thickness is tenfold at approximately 2 μm and at 380° C. again ten times thicker at approximately 20 μm. In view of this, a specific embodiment of the process according to the invention is characterized in that said heat treatment is carried out in a molten salt bath at a temperature between 300° C. and 600° C. and preferably at a temperature between 330° C. and 450° C.

Also processing of pre-heat treated substrates, limits the maximum allowable process temperature in the process according to the invention. In such cases the coating temperature is maintained typically below 450° C., preferably between 330° C. and 400° C.

In order for a substrate to be properly coated by zinc-diffusion, an inter-metallic reaction must occur with the surface; i.e. zinc does not only need to grow onto the surface but also needs to react with the substrate material. Otherwise, merely an additional thin zinc layer will be deposited, maintaining the system in thermodynamic equilibrium, and a further layer thickening by layer growth will not take place. Inter-metallic phase reactions are diffusion-controlled and thus temperature-dependent. In general, the higher the temperature, the faster a layer thickening can take place, provided that sufficient zinc source is present, whereby temperature here is primarily the substrate temperature.

Metallic bare surfaces require usually no pre-treatment and in many other cases a pretreatment by shot blasting is sufficient. This way hydrogen embrittlement may be avoided. Most grades of steel and other alloys may be coated by means of the process of the invention. In this respect a preferred embodiment of the process according to the invention is characterized in that the substrate comprises a zinc-alloyable metal, preferably at least one of iron, copper, nickel, aluminum or one of their alloys, such as steel, and said metal layer comprises a corresponding zinc alloy layer on said substrate. At relative moderate process temperature, that may be well below the melting point of zinc ($T_M$=419.5° C.), e.g under 410° C., the process renders itself also suitable for parts that are already coated as well as for high-strength materials.

The invention allows a wide variety of salts to be used for the salt melt in which the coating process is carried out. As such, a preferred embodiment of the process according to the invention, is characterized in that a majority of said diffusion medium consists of said at least one molten salt, preferably a combination of two or more molten salts, having a melting point below or equal to said elevated temperature and in that said one or more salts are selected from a group that consists of halides, cyanides, cyanates and mixtures thereof.

A preferred embodiment of the process according to the invention is characterized in that said salts are selected from a group of halides, specifically from a group of halides that consists of chlorides, bromides and iodides, and more particularly in that said halides comprise one or more alkali metal halides or alkaline-earth metal halides. As being especially suitable within the framework of the present invention, said halides preferably comprise one or more salts from a group consisting of zinc chloride, potassium chloride, barium chloride, calcium chloride, sodium chloride and aluminum chloride. In this respect, according to a specif embodiment of the process according to the invention chlorides are preferred in view of (environmental) safety, economics and physical properties, like (water) solubility, melting point and density.

These salts are known to be very corrosive and hygroscopic and readily soluble in water. On basis of the zinc chloride, they show only a very limited solubility for the intrinsic metal ions of about 1 at. %. None of these salts, hence, will act as a zinc donor. Such a molten salt could offer itself as an aggressive quenching medium. It is by no means known, nor obvious, to use such a mixture as a diffusion medium for zinc diffusion coating.

As the process of the invention may be carried out in an open bath of said molten salt liquid, it facilitates a simple process integration, particularly allowing the integration of the process in a continuous production or assembly line, and by using a liquid salt melt as diffusion medium the process will not be dusty. Since these molten salt baths contain no hydrogen, hydrogen embrittlement is unlikely to occur.

The melting points of the individual salts, particularly the chlorides, bromides or iodides, may be above said elevated process temperature, but eutectic mixtures can be prepared whose melting points are significantly lower. In this respect a preferred embodiment of the invention is characterized in that the diffusion medium comprises a molten salt liquid of a combination of two or more salts. Using such a mixture of different salts will give rise to a favourable melting point reduction. For example, an eutectic mixture of $ZnCl_2$ (0.6 mol %, $T_M$=290° C.), NaCl (0.2 mol %, $T_M$=801° C.) and KCl (0.2 mol %), $T_M$=773° C.) has a comparatively reduced melting point of about 203° C. Lower melting points usually show favourable properties in terms of viscosity, diffusivity (diffusion rate) and solubility.

In a further preferred embodiment the process according to the invention is characterized in that said metallic zinc source is added in the form of granules, chips, powders or mixtures, preferably with a powder particle size of less than 100 microns and more preferably with a particle size of less than 50 microns. Besides zinc grains (granules) or chips (flakes), also zinc powder or zinc dust may be used as this zinc-source. The finer the particle size, the easier the transition of zinc into the melt will be.

A further specific embodiment of the process of the invention is characterized in that the substrate is subjected to a heat pre-treatment before being quenched in a bath of said molten salt liquid, while said molten salt liquid has an initial bath temperature below the process temperature. Thereby the molten salt liquid is used as a quenching medium and the initial temperature of the molten salt liquid is adjusted to its use for quenching of the substrate and maintained at a correspondingly relatively low value of for instance 200° C. An initially higher substrate temperature, in that case, enables a phase reaction with zinc, allowing the surface to be plated more readily. Furthermore, the zinc protects the substrate immediately against the quenching medium that would otherwise be corrosive to the substrate.

EXAMPLE

To carry out the process according to an embodiment of the present invention, a salt melt is prepared in a suitable heatable container, for example, from a mixture of about 0.6 mol % $ZnCl_2$, about 0.2 mol % NaCl and ca. 0.2 mol % KCl. The handling of salt melts is not without risk, therefore, normal expert safety measure should be taken. These salts may be hygroscopic and in that case are first purified by sustained settling for a period of time to free and remove any crystal water and possible dissolved gases so that no bubbles will form and foaming of the melt is prevented. In order that the purification process does not proceed too fast, it is advantageous to start at moderate temperatures of e.g. 250° C. and slowly heat up the salt bath to the desired process temperature or even slightly beyond that temperature. This may take several hours, or longer, and depends on the degree of crystal water and outgassing.

Once the salt bath has settled and water or gasses have escaped. A gaseous reaction with residues may occur. Once this has ended, the salt bath is stable and ready for coating. Metallic zinc is prepared and added as metallic zinc source to the melt. For this purpose, at least the amount of zinc necessary to achieve the desired layer weight (thickness) plus an excess amount of zinc of for instance at least 3 wt.-% is introduced in the molten salt. Besides to zinc grains (granules) or chips, also zinc powder or zinc dust may be used as this zinc-source. The finer the particle size, the easier the transition of zinc into the melt will be.

The substrates to be coated may be cleaned before the treatment, if necessary. The salt bath that is being used may also have a cleansing effect. In principle, any conventional method is suitable, like de-greasing and sand blasting. Non-metallic coatings, such as oxides or skins, should be removed. In order to avoid hydrogen embrittlement, preferably only blasting is used. Subsequently, the dry substrates can be placed in baskets or attached to appropriate carriers in or onto which the substrates are further processed.

Subsequently, the thus prepared substrates are completely submersed in the molten salt bath, in this example at a process temperature of about 380° C. for about 1 hour in the presence of said zinc source. This delivers a highly uniform zinc diffusion coating of the desired thickness even when applied to extremely complex substrate geometries. A comparable result is obtained in carrying out the process according to another embodiment of the present invention, when instead of the ternary salt bath, a salt bath is used with only $ZnCl_2$.

It should be noted that thereby the zinc source resides in the melt at a temperature well below 420° C., i.e. still in its solid phase, the melting point of metallic zinc being 419.5° C. The transfer of zinc apparently is merely effected by zinc diffusion from the zinc source through the molten salt to the substrate surface, which triggers an inter-metallic phase reaction with the zinc at the substrate surface. The coating process takes place without the object or the bath being disturbed.

In an alternative embodiment of the invention, the diffusion medium is circulated during the process. Such a circulation of the melt is advantageous, particularly in the case of large substrate surfaces, so that an optimum local zinc supply as well as a uniform temperature distribution and coating are achieved.

In order that no contact points arise on the surfaces to be coated or that bubbles form in any cavities, a further embodiment of the process according to the invention is characterized in that the substrate is moved during the process through said molten salt liquid. Such movement of the substrate during the coating process ensures that all surfaces are sufficiently wetted and a uniform layer can grow everywhere on its surface.

A wide variety of molten salts may be used for the diffusion medium, however, a preferred embodiment of the process according to the invention is characterized in that salts are being used that are soluble in a convenient solvent, particularly in water. In that event, remaining salts that solidified or precipitated on the surface or in any substrate cavities, can be removed quite easily by rinsing or washing afterwards with the appropriate solvent.

In one embodiment of the process according to the present invention, the racks or baskets that are used to hold the substrate during the heat treatment and coating process can also conveniently be used for subsequent post-treatments, such as washing or passivating.

Depending on the later intended use of the coated substrate, it may be advantageous to passivate, coat or rubberize the coated substrate after the heat treatment. In principle, any desired post-treatment, such as passivating, sealing, painting or rubberizing of the surface may be applied.

Depending on the size of the salt bath and the substrate, the cost for constructing and filling the salt bath can be considerable. In order to reduce this initial investment, a further preferred embodiment of the process according to the invention is characterized in that a solid filler is added to said diffusion medium, particularly in the form of an inert powder. Such fillers reduce the active volume and can be supplied to the salt bath to save on its salt contents without adversely affecting the diffusion and coating behaviour of zinc. Although many filler materials are feasible within the framework of the present invention, especially silicates and more particularly a fumed silicate that is commercially available under the brand Aerosil® may be highly suitable for this purpose.

Particularly suitable for this purpose are inert powders or flakes whose density differs as little as possible from the density of the molten salt liquid and can therefore be easily moved and distributed in the melt. A particular embodiment is therefor characterized in that said solid filler has a density which does not exceed a density of said molten salt liquid by more than 25%. Based on the density of the above ternary melt of about 2.43 g/cm$^3$ (250° C.), modifications of silicates, particularly silicon oxide (e.g. tridymite with 2.28 g/cm$^3$ or quartz 2.65 g/cm$^3$) are suitable for this purpose and also graphite dust (2.26 g/cm$^3$).

Although the invention has been described in further detail with reference to merely a single explanatory embodiment only, it should be noted that the invention is by no means limited to this embodiment. On the contrary, many more embodiments and variations are feasible within the scope of the present invention to a person of ordinary skill without requiring him to exercise any inventive effort.

As such the aforementioned specific compounds, although very suitable within the context of the present invention, may be replaced by other compounds. The examples gives focussed of the formation of a pure zinc layer. The invention, however, is likewise suitable for forming layer comprising zinc in combination with traces of one or more other compounds, notably metals like chromium, nickel, magnesium and copper, to form ternary conformal metal layers covering and shielding the surface of the substrate.

More generally, the present invention offers an entirely new and inventive process for forming a protective layer on a substrate, specifically a metal substrate, said layer comprising zinc and optionally one or more other elements, based on metal diffusion from an appropriate source through a suitable liquid medium, notably a salt melt. This will open a door to a widespread variety of application in which the process according to the invention will easily outweigh traditional coating and deposition techniques, particularly electro-galvanizing and hot-dip galvanizing, in terms of layer thickness (control), conformability and economics.

The invention claimed is:

1. A process for coating a surface of a substrate with a metal layer, said process comprising:

bringing together a coating agent containing zinc and said substrate in a diffusion medium and subjecting the coating agent and said substrate to a heat treatment at an elevated temperature to allow a diffusion of zinc through said diffusion medium to said surface of said substrate, wherein said diffusion medium consisting of a molten salt comprising at least one molten salt, wherein said coating agent comprises a metallic zinc source as a source for diffusion of zinc to said surface of said substrate, and wherein said heat treatment includes submerging said substrate in said molten salt at said elevated temperature to allow metallic zinc to diffuse to said substrate.

2. The process according to claim 1, wherein said molten salt is maintained at an elevated bath temperature of between 200° C. and 800° C. during said heat treatment, while said substrate is submerged in said molten salt bath of said molten salt.

3. The process according to claim 2, wherein said heat treatment is carried out in said salt bath at a temperature between 300° C. and 600° C.

4. The process according to claim 3, wherein said heat treatment is carried out in said salt bath at a temperature below 450° C.

5. The process according to claim 4, wherein said heat treatment is carried out in said salt bath at a temperature between 330° C. and 400° C.

6. The process according to claim 1, wherein the substrate comprises a zinc alloyable metal and said metal layer comprises a corresponding zinc alloy layer on said substrate.

7. The process according to claim 6, wherein the substrate comprises at least one of iron, copper, nickel, aluminum, steel and cast iron.

8. The process according to claim 1, wherein a majority of said diffusion medium consists of said at least one molten salt having a melting point below or equal to said elevated temperature and wherein said one or more salts are selected from a group that consists of halides, cyanides, cyanates, and mixtures thereof.

9. The process according to claim 8, wherein said salts are selected from a group of halides.

10. The process according to claim 9, wherein said halides comprise one or more salts from a group consisting of zinc chloride, potassium chloride, barium chloride, calcium chloride, sodium chloride, and aluminum chloride.

11. The process according to claim 9, wherein said salts are selected from a group of chlorides, bromides, and iodides.

12. The process according to claim 8, wherein said halides comprise one or more alkali metal halides or alkaline earth metal halides.

13. The process according to claim 8, wherein a majority of said diffusion medium consists of a combination of two or more molten salts.

14. The process according to claim 1, wherein said metallic zinc source is added in the form of granules, chips, powders, or mixtures to the process.

15. The process according to claim 14, wherein said granules, chips, powders, or mixtures have a powder particle size of less than 100 microns.

16. The process according to claim 15, wherein said granules, chips, powders, or mixtures have a powder particle size of less than 50 microns.

17. The process according to claim 1, wherein the molten salt is circulated during the process.

18. The process according to claim 1, wherein the substrate is moved during the process through the molten salt.

19. The process according to claim 1, wherein after deposition of said metal layer on said surface, the substrate is post treated by washing, passivating, painting, rubberizing or any combination thereof.

20. The process according to claim 1, wherein said substrate is subjected to a heat pre-treatment before being quenched in said molten salt.

21. The process according to claim 20, wherein said molten salt has an initial bath temperature below the process temperature.

22. The process according to claim 1, wherein a solid filler is added to said molten salt.

23. The process according to claim 22, wherein said solid filler has a density which does not exceed a density of said molten salt by more than 25%.

24. The process according to claim 22, wherein said solid filler is chosen from a group of silicates and carbons, and particularly comprises silicon oxide.

25. The process according to claim 22, wherein a solid filler is added to said molten salt in the form of an inert powder.

* * * * *